United States Patent [19]

Diel

[11] Patent Number: 4,936,209

[45] Date of Patent: Jun. 26, 1990

[54] ELECTRONIC POSTAGE METER WITH ZIP CODE LOCATION DESIGNATION

[75] Inventor: Paul A. Diel, Fairfield, Conn.

[73] Assignee: Pitney Bowes Inc., Stamford, Conn.

[21] Appl. No.: 290,347

[22] Filed: Dec. 29, 1988

[51] Int. Cl.[5] ..... B41J 9/42

[52] U.S. Cl. ..... 101/93.01; 101/91; 101/110; 177/5; 237/130 R

[58] Field of Search ..... 101/91, 109, 110, 93, 101/93.01; 364/464.02, 464.03; 177/4, 5, 124, 25.11, 25.12, 25.13; 209/900; 235/130 R

[56] References Cited

U.S. PATENT DOCUMENTS

| | | | |
|---|---|---|---|
| 3,635,297 | 1/1972 | Salava | 177/5 |
| 3,757,942 | 9/1973 | Gunn | 101/91 |
| 4,024,380 | 5/1977 | Gunn | 177/5 |
| 4,168,533 | 9/1979 | Schwartz | 101/91 |
| 4,408,524 | 10/1983 | Nuckel et al. | 101/110 |
| 4,506,330 | 3/1985 | Dlugos | 177/4 |
| 4,519,311 | 5/1985 | Lowe | 101/109 |
| 4,649,490 | 3/1987 | Manduley et al. | 177/25.13 |
| 4,676,155 | 6/1987 | Harry et al. | 101/91 |

*Primary Examiner*—Eugene H. Eickholt

*Attorney, Agent, or Firm*—Michael J. DeSha; David E. Pitchenik; Melvin J. Scolnick

[57] ABSTRACT

A postage meter die in a postage meter includes a printwheel assembly for printing ZIP CODE or other location information in place of the CITY-STATE information normally required for Post Office licensed postage meters. The printer assembly is accessible by authorized personnel to allow the ZIP CODE to be changed to correspond to the ZIP CODE location of the meter user.

3 Claims, 2 Drawing Sheets

ELECTRONIC POSTAGE METER WITH ZIP CODE LOCATION DESIGNATION

BACKGROUND OF THE INVENTION

The invention relates to postage meters, and more particularly, to the postage meter dies for printing the meter indicia.

Postage meters are well known. Conventionally, such postage meters have a print drum or flat-bed which includes a letter press die having a fixed engraved indicia which when inked will print onto an envelope a replica of the indicia on the die. Under U.S. Post Office regulations, normally, the required information on this die includes a meter number along with the city and state of the licensing post office. There are about 30,000 post offices for which different dies must be available. The meter manufacturers must maintain an inventory of different engraved dies for each of the cities in each of the states in which Post Offices license postage meters.

BRIEF SUMMARY OF THE INVENTION

It has been found that with a die in accordance with the invention, a significant reduction in the number of different dies which have to be stocked may be achieved.

The domestic mail manual provides that as an alternative to the city/state die, a manufacturer may substitute a zip code location designation. In accordance with the invention, a postage meter is provided with a fixed printing die having disposed for printing therewith a plurality of printwheels which may be set to a number indicating the zip code designation. The indicia will also include the words "MAILED FROM ZIP CODE". The printwheels may be set to a given zip code when the meter is to be installed and then locked to prevent changing. Therefore, when the postage meter prints the indicia, it will include the ZIP CODE location elimination is required.

DESCRIPTION OF THE PREFERRED EMBODIMENT

Figure 1:
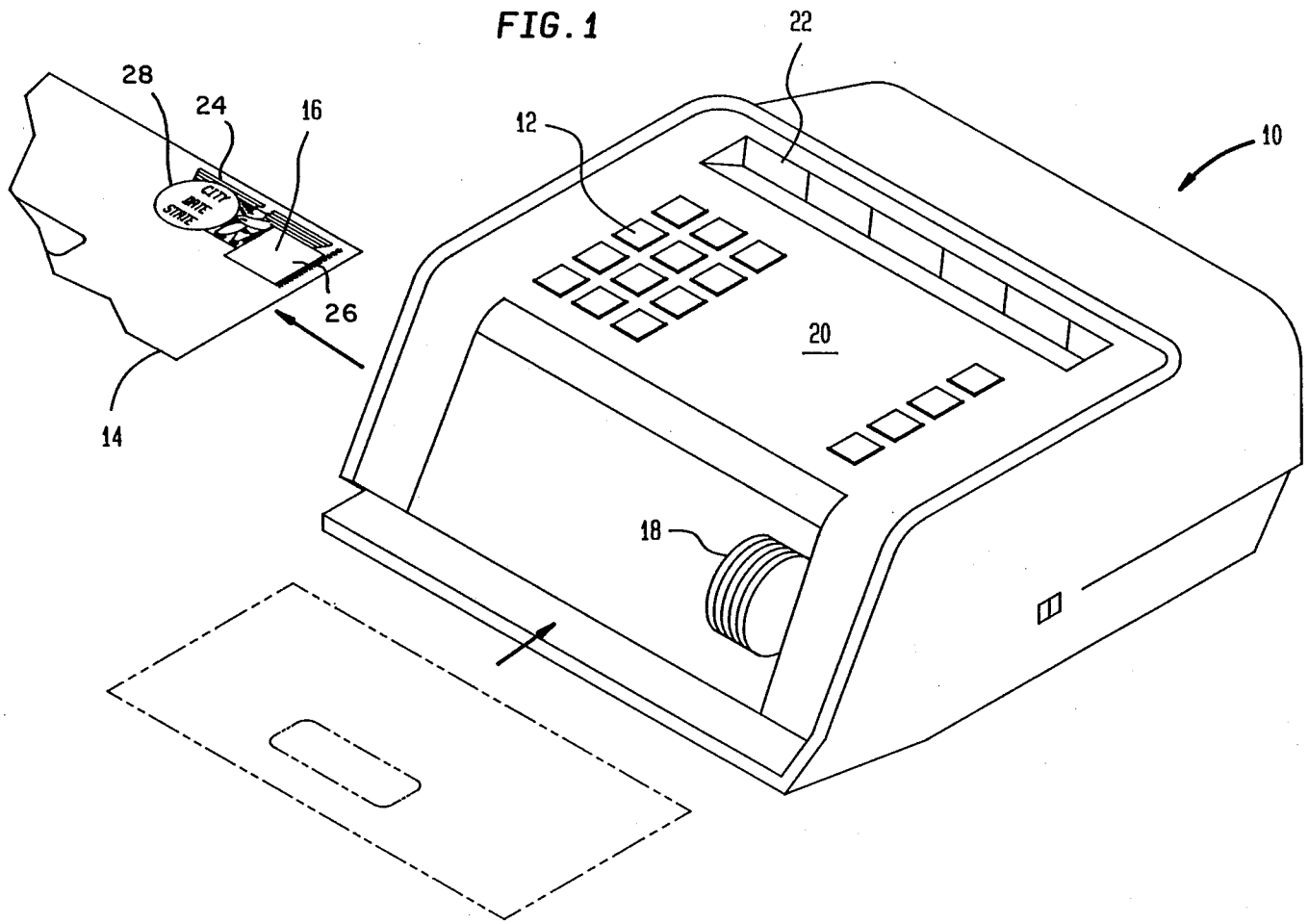
FIG. 1 shows a flat-bed printing postage meter in which the invention may be incorporated.

Referring to FIG. 1, a postage meter 10 in which a zip code location printing device in accordance with the invention may be arranged is shown. The illustrated meter 10 is of the flat-bed printing type which contains printing means to print a postal indicia on a mailpiece, a selection mechanism to select the amount of postage as desired to be imprinted, and a register to keep an accurate account of the value of postage imprinted. The meter 10 has the capability through an input keyboard 12 in the surface 20 for selection of postage value in accordance with operator requirements. A letter 14 imprinted with a conventional indicia 16 is shown being ejected from the meter. The selected postage is physically set on printwheels indicated schematically at 18 and is further displayed in display 22.

To operate the meter, the operator selects the desired postage value using the keyboard 12, which value is then displayed in the display 22. An envelope 14 to be imprinted with postage is inserted in opening in the lower front portion of the meter. When the envelope is fully inserted, the cycle of the meter is initiated during which time the postal indicia 16 is printed on the envelope and the value of the postage is imprinted as recorded in the register.

A postal indicia 16 as it is shown and printed on the envelope 14 consists of a number of parts. The main part is a postal design 24 which is approved by government. Within this design is a value printing area 26 in which the actual amount of postage is printed as described above, and the so called "TOWN CIRCLE" area 28 which, as required by postal regulations is used to show the licensing Post Office location. A further description of this machine may be obtained from U.S. Pat. No. 4,579,054, entitled STAND-ALONE ELECTRONIC MAILING MACHINE, specifically incorporated herein by reference.

Returning to the description of the main part of the postal design 16 and Town-circle in which is typically imprinted the name of the city and state in which the licensing post office for the particular meter is situated, the manufacturer is required to provide engraved dies for its postage meters for customers in each of these licensing post office locations. It will be appreciated that this leads to a requirement for a very large inventory of dies to accommodate those customers requiring a new installation as well as those who are moving from one location to another.

As mentioned previously, the Domestic Mail Manual which provides the regulations for postage meters allows the manufacturer to use an alternative to the Town-circle imprint shown in FIG. 1. The Domestic Mail Manual states:

> "As an alternative, the Zip Code designation may be shown in the meter post mark instead of the city/-state designation. When this occurs, the words "MAIL FROM ZIP CODE" must appear in place of the city designation and the mailer's delivery address Zip Code in place of the state".

In accordance with the invention, printing apparatus is provided to apply selectively changeable Zip Code numerals in the otherwise fixed print die. It will be understood that any predetermined postal location code could be substituted for the Zip Code to allow printing of a selected predetermined code.

Figure 2:
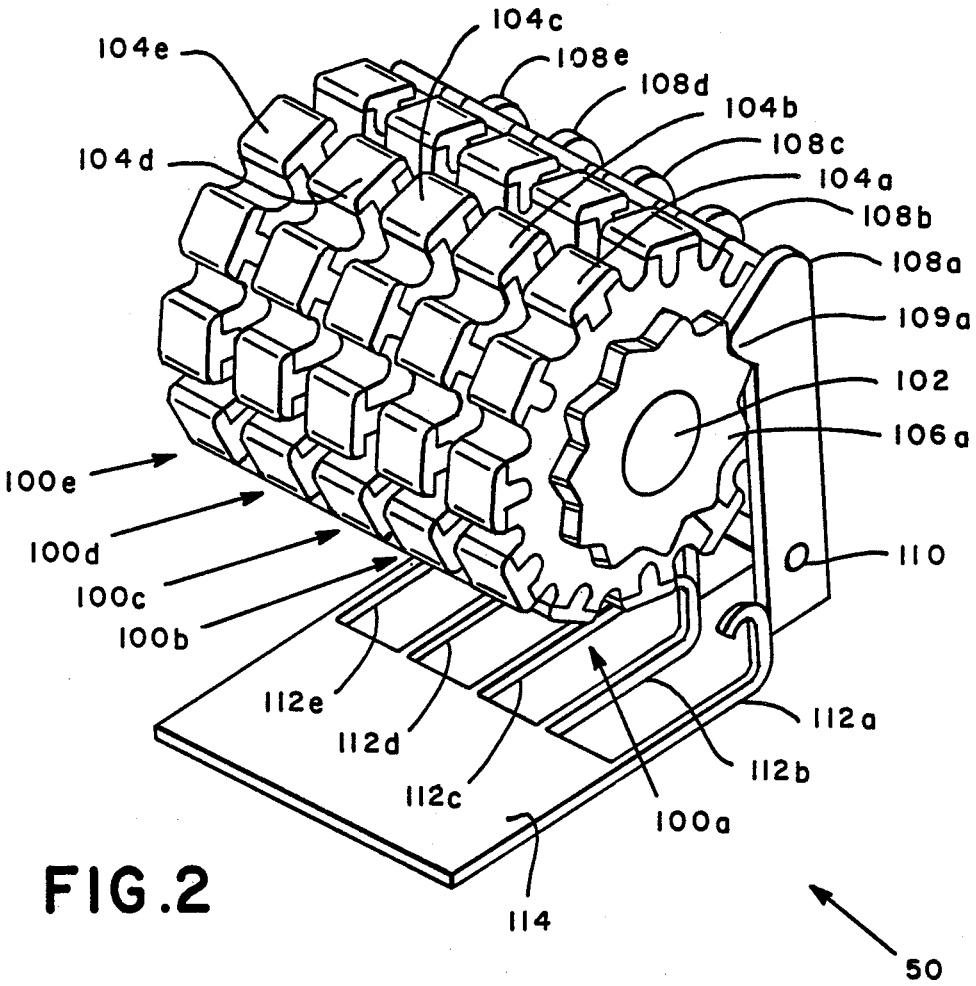
FIG. 2 is a perspective view of a suitable printwheel arrangement which may be incorporated in the postage meter of FIG. 1 for printing the postage meter zip code.

FIG. 2 shows at 50 a perspective view of a module having a suitable bank of printwheels incorporated in the postage meter for accomplishing the printing of the Zip code. While the figure shows five (5) individual printwheels, it Will be understood that any number of printwheels may be accommodated to correspond as required to a ZIP plus 4 postal code or a ZIP plus 6 postal code. It will also be understood that the printwheels may be incorporated in a print drum arrangement. It will also be appreciated that other devices such as belts carrying numerals are also contemplated with as being the scope of the invention.

Figure 3:
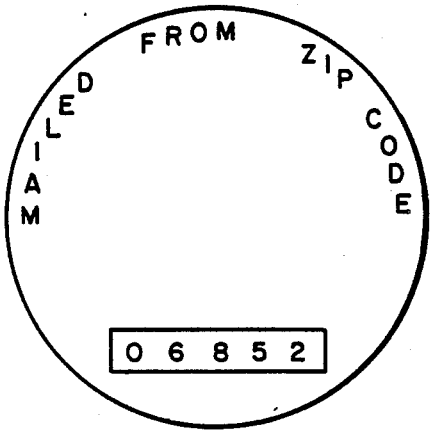
FIG. 3 illustrates the printing of the Zip Code circle of the indicia in accordance with the invention.

As shown in FIG. 2, printwheels 100*a*, 100*b*, 100*c*, 100*d* and 100*e*, are mounted for individual rotation about a shaft 102 which in turn is mounted, suitably by brackets (not shown), to the postage meter 10 at a position for imprinting a five (5) digit Zip Code within the indicia as shown in FIG. 3. Each printwheel has projections such as 104*a*, 104*b*, 104*c*, 104*d* and 104*e* thereon which carry numerals which may be selectively set into printing position. Each printwheel conveniently has a corresponding star wheel such as is shown at 106*a*, respectively affixed thereto as seen on wheel 100*a*. Locking pawls 108*a*, 108*b*, 108*c*, 108*d* and 108*e* are pivotally mounted on shaft 110 (also affixed to brackets not shown) and held in position such that the respective noses such as 110, seen on pawl 106*a*, extends into the detents on the corresponding star wheels and are held in position by springs 112*a* through 112*e*, extending from flat plate 114. It will be appreciated that the entire assembly can be also provided as a module to be attached to the postage meter 10.

For best results, it will be understood that the arrangement shown is disposed in the secure or tamper-resistant area of a postage meter and is accessible only by the Post Office or by manufacturer's personnel who are authorized to enter the secure area of the postage meter. Accordingly, it is preferred from a security standpoint that the ZIP code designation printwheels are not accessible to the operator of the postage meter.

It will also be appreciated that in the embodiment illustrated in FIG. 2, each of the printwheels are intended to be mechanically picked over for movement to a new location. If desired, each printwheel could be individually driven by a setting motor or any or all of the printwheels could be connected using a known geneva transfer mechanism so that the movement of a lower order wheel could be transmitted to a higher order wheel.

FIG. 3 shows a circle of the indicia having a typical ZIP code in accordance with the invention.

What is claimed is:

1. In a postage meter having a die for printing an indicia, the improvement comprising printing elements for selectively printing numerals representative of a postal location code representative of the location of the meter, said printing elements being disposed for printing in conjunction with a permanent portion of said die and being located in a secure portion of said postage meter, means for changing at least one of said printing elements for printing another numeral upon accessing said secure portion and means for locking each of said print element in position for printing said numerals whereby said member cannot be changed unless said secure portion is accessed.

2. A method for changing an indication of location in a postage meter comparing the steps of:

(a) providing print elements located in a tamper-resistant area of a postage meter, said print elements having numerical characters thereon disposed for printing a postal location code representative of the location of the meter; said print elements having means for locking each said numerical character in a printing location;

(b) accessing said tamper-resistant area and unlocking at least one said print element;

(c) changing said at least one of said print elements to place another of said numerical characters in printing position;

(d) locking said at least one print element to prevent changing thereof; and (e) resecuring said tamper resistant area.

3. The postage meter of claim 1 wherein the postal location code is a ZIP CODE.

* * * * *